United States Patent [19]

Parrish, II

[11] 4,012,033

[45] Mar. 15, 1977

[54] CONVEYING AND STACKING APPARATUS

[76] Inventor: John C. Parrish, II, 504 Conquistador Drive, Largo, Fla. 33540

[22] Filed: Apr. 24, 1974

[21] Appl. No.: 463,785

[52] U.S. Cl. ..... 271/64; 271/177; 271/184; 271/193; 271/195; 271/198; 271/219; 271/DIG. 9

[51] Int. Cl.[2] ..... B65H 21/62; B65H 29/24

[58] Field of Search ..... 271/64, 177, 184, DIG. 9, 271/195, 200, 219, 224, 198, 193, 225

[56] References Cited

UNITED STATES PATENTS

| | | | |
|---|---|---|---|
| 1,193,627 | 8/1916 | Staude | 271/225 X |
| 2,478,610 | 8/1949 | Uschmann et al. | 271/64 X |
| 2,796,260 | 6/1957 | Willard | 271/219 |
| 2,897,952 | 8/1959 | Buccicone | 271/193 X |
| 3,310,169 | 3/1967 | Forrester | 271/64 X |
| 3,315,958 | 4/1967 | Geeson | 271/193 |
| 3,387,779 | 6/1968 | Steffens | 271/184 X |
| 3,471,142 | 10/1969 | Bergez | 271/64 |

*Primary Examiner*—Evon C. Blunk
*Assistant Examiner*—Bruce H. Stoner, Jr.
*Attorney, Agent, or Firm*—Cushman, Darby & Cushman

[57] ABSTRACT

A sheet material conveying and stacking apparatus is provided which utilizes a pivotally connected conveyor having air jets with a further conveyor located downstream also having air jets. The pivotally connected conveyor is placed in a first position so that sheets of material will be transported to the subsequent conveyor which utilizes air jets to displace the sheets of material onto a further conveyor which transports the sheets to a weight-responsive stacker. After the sheets have filled the stacker, the pivotally connected conveyor may be pivoted to a second position which locates the air jets above the passline of the sheets being transported by the conveyor preceding the pivotal conveyor. The sheets are then displaced by the air jets onto another conveyor located below the air jets, the sheets then being stacked in another weight-responsive stacker.

17 Claims, 6 Drawing Figures

CONVEYING AND STACKING APPARATUS

BACKGROUND OF THE INVENTION

A. Field of the Invention

This invention relates to a classifier or a conveying and stacking system for transporting sheets of material and stacking or classifying the sheets into separate piles. More particularly, the present invention describes a conveying and stacking system which utilizes a pivotal conveyor having a means for forcing air onto sheets of material being conveyed when the pivotal conveyor is arranged in a position so that it may not further convey the sheets. The sheets are forced downwardly onto a further conveyor after being struck by the air jets. The sheets are then transported to a stacking means.

The present invention also utilizes a conveyor which is located downstream from the pivotal conveyor and which also employs air jet means for forcing sheets of material onto another conveyor which transports the sheets onto another stacking means.

B. Background of the Invention

Article conveying systems are well known in the prior art, and a typical example is disclosed in U.S. Pat. No. 3,339,705. Here, there is set forth a device for conveying articles which utilizes two conveyor belts through which an item is transported. The items are engaged by resilient impellers which extend radially outward from a roller so that the impellers contact the items and urge them towards an intercepting member. The items are then dropped downwardly onto another conveyor belt which transports the items to a succeeding processing device. U.S. Pat. No. 3,339,705 does not disclose a conveying system which will transport sheets of material at a relatively high rate of speed and then force the material onto another conveyor by means of air jets whereupon the sheets will be stacked upon a weight responsive stacking means. The present invention provides these features and is therefore a significant step ahead in the article conveying art.

Another stacker apparatus of relevance is disclosed in U.S. Pat. No. 3,729,188, wherein a stacking apparatus stacks documents at very high speeds. The documents are transported to a stacking bin by a belt transport system, the documents being continuously in contact with the belt. As the document approaches the stacking bin, a roller adjacent thereto forces the trailing edge of the document downward onto the stack. While U.S. Pat. No. 3,729,188 is satisfactory for stacking documents, it does not employ the novel features of the present invention. The handling of sheets of metallic material transported at a high rate requires a means for forcing the sheets downwardly onto another conveyor for high speed stacking.

In U.S. Pat. No. 3,608,695 there is disclosed a conveyor assembly for pieces of lumber for obtaining a uniform flow rate of the pieces so they may be arrested and then permitted to arrive at a pre-determined position with respect to the lugs of a high speed conveyor. The pieces or boards are then released one board at a time at predetermined time intervals. U.S. Pat. No. 3,603,695 does not set forth a system for stacking sheets of material at high rates of speed using the pivotal conveyor having air jet means of the present invention.

A method for automatically stacking lightweight plastic articles being ejected from plastic shaping equipment which involves air conveying the article as disclosed in U.S. Pat. No. 3,685,671. In this patent, plastic articles which are ejected from plastic shaping equipment are conveyed by air jets and then turned by air jets into a stack of trays which are accumulated within a container. U.S. Pat. No. 3,685,671 further discloses dual friction wheels aligned opposite each other on the discharge end of the duct leading to the container. Means for rotating the friction wheels at a constant speed to stack the articles is also provided. This patent does not disclose a pivotal conveying means having air jets used in conjunction with another conveyor having air jets to form two stacks of material.

SUMMARY OF THE INVENTION

A principle object of the present invention is to provide for a sheet material conveying and stacking apparatus which will transport thin sheets of material at relatively high rates of speed from a sheet producing source to various stacks.

Another object of the present invention is to provide for a sheet material conveying apparatus in which one conveying means is pivotally connected at one end so that sheets of material being conveyed by preceding conveying means are passed beneath the pivotally connected conveying means so that jets of air are blown onto the sheets of material. The sheets, being subjected to the blast of air, are rapidly displaced to a further conveying means which then transports the sheets to a weight-responsive stacking means.

A further object of the present invention is to provide for a sheet material conveying apparatus in which air jet means are located adjacent to a non-pivotal conveying means so that sheets of material passing from the conveying means are subjected to a blast of air from the air jet means to displace the sheets onto a further conveying means which transports the sheets to a weight-responsive stacker.

Yet another object of the present invention is to provide for a sheet material conveying apparatus which utilizes both a pivotally connected conveying means having air jets with a further conveying means located downstream also having air jet means. The pivotally connected conveying means is placed in a first position so that sheets of material will be transported to the subsequent conveying means which utilizes air jets to displace the sheets of material onto a further conveying means which transports the sheets to a weight-responsive stacker. After the sheets have filled the stacking means, the pivotally connected conveying means may be pivoted to a second position which locates the air jet means above the passline of the sheets being transported by the conveying means preceding the pivotal conveying means. The sheets are then displaced by the air jet means onto another conveying means located below the air jet means, the sheets then being stacked in another weight-responsive stacker.

A further object of the present invention is to provide for a sheet material conveying and stacking apparatus which may be adapted to feed sheets of material to a plurality of positions i.e., the pivotal conveying means by virtue of its being positionable in several positions, will enable the conveying system to either stack sheets of material at a location distant from the sheet producing source or at a location intermediate of the sheet producing source and the distant location.

A further object of the present invention is to provide for a sheet material conveying and stacking apparatus in which a large number of sheets may be conveyed. Also, the present invention contemplates the use of conveying means each having an upper stage which insures that thin sheets of material will be transported by a conveyor belt of the conveying means during a rapid rate of transport.

Another object of the present invention is to provide for a sheet material conveying and stacking apparatus which employs a sensing means for actuating the pivotally connected conveying means when a stacking means located downstream is full so that a stacking means located adjacent to the pivotally connected conveying means may then be operatively filled.

Yet another object of the present invention is to provide for a sheet material conveying and stacking apparatus in accordance with the features as outlined above wherein the conveying means are disposed above a floor surface or the like by a plurality of upright supports, a further conveying means and a bin being provided beneath the conveying means for containing reject sheets of material.

Additional objects of the present invention reside in the specific construction of the exemplary apparatus hereinafter particularly described in the specification and shown in the several drawings.

BRIEF DESCRIPTION OF THE DRAWINGS

Novel features of the improved sheet material conveying apparatus in accordance with the present invention will be more readily understood from a consideration of the following description, taken together with the accompanying drawings, in which certain preferred adaptations are illustrated with the various parts thereof identified by suitable reference characters in each of the view, and in which.

DETAILED DESCRIPTION OF THE INVENTION

Figure 1:
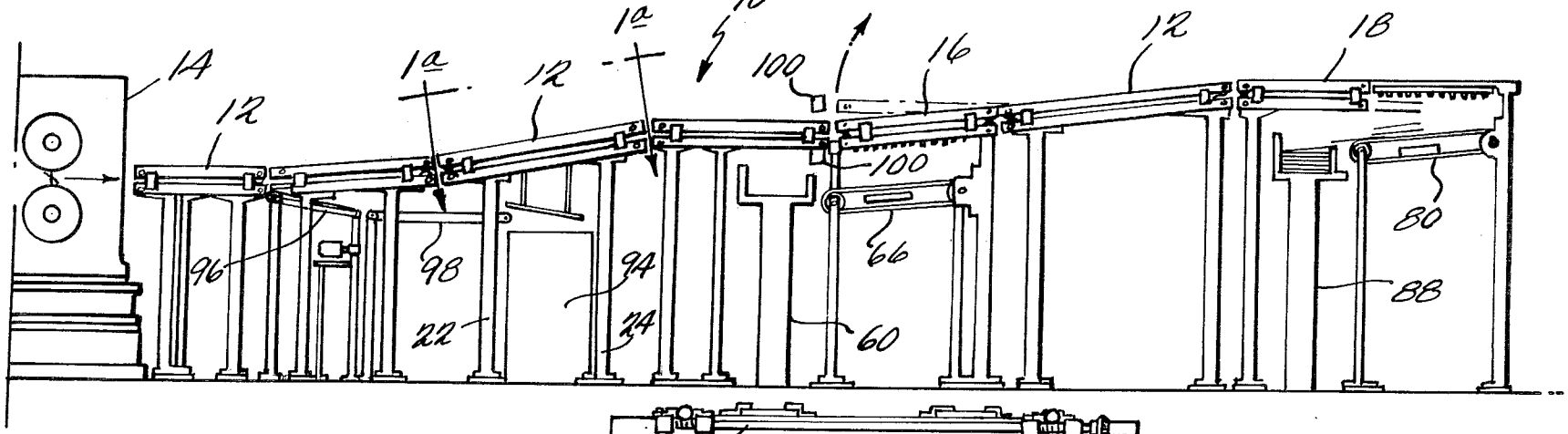
FIG. 1 is a side elevational view of the sheet material conveying and stacking apparatus showing a plurality of conveying means leading from a sheet material producing source to at least two stacking means.

Referring now to the drawings, there is illustrated in FIG. 1 an embodiment of the sheet material conveying means of the present invention generally designated at 10. The conveying means consists of a plurality of conveyors which includes a first conveyor 12 located adjacent to a sheet producing source 14. The sheet producing source 14, in a typical arrangement, is a shearing machine which cuts metal sheets into predetermined lengths and feeds the sheet material to the first conveyor 12.

In accordance with the present invention, it is contemplated that the sheet material sheared will be relatively thin. In a typical application, the feed material is contemplated as having a strip speed from the shear of approximately 1500 feet per minute. Because of this high rate of speed and also because the sheet material may be relatively light, the preferred embodiment of the invention requires conveyors with an upper portion or stage which will secure the sheet material being transported to a lower portion of the conveyor.

Figure 1A:
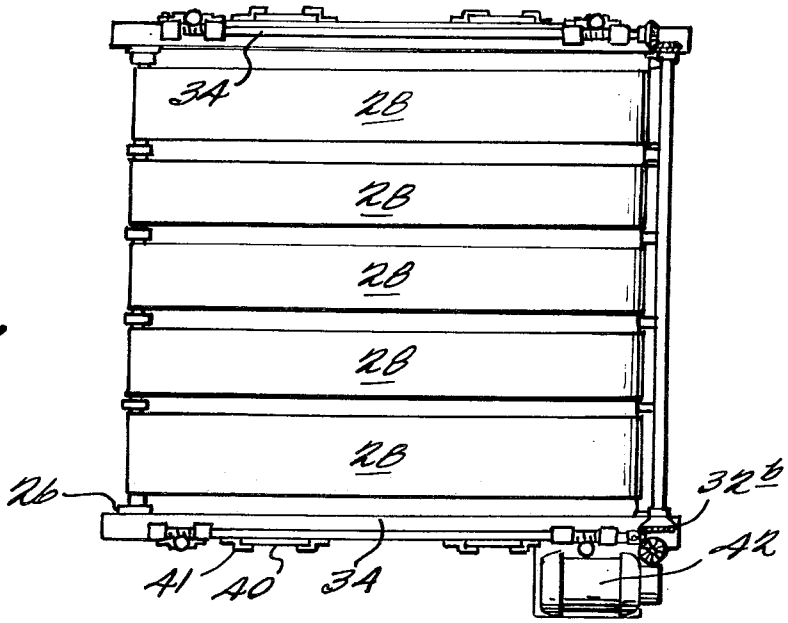
FIG. 1*a* is a view taken along lines 1*a*—1*a* of an intermediate conveying means and shows a plurality of conveying belts.
Figure 2:
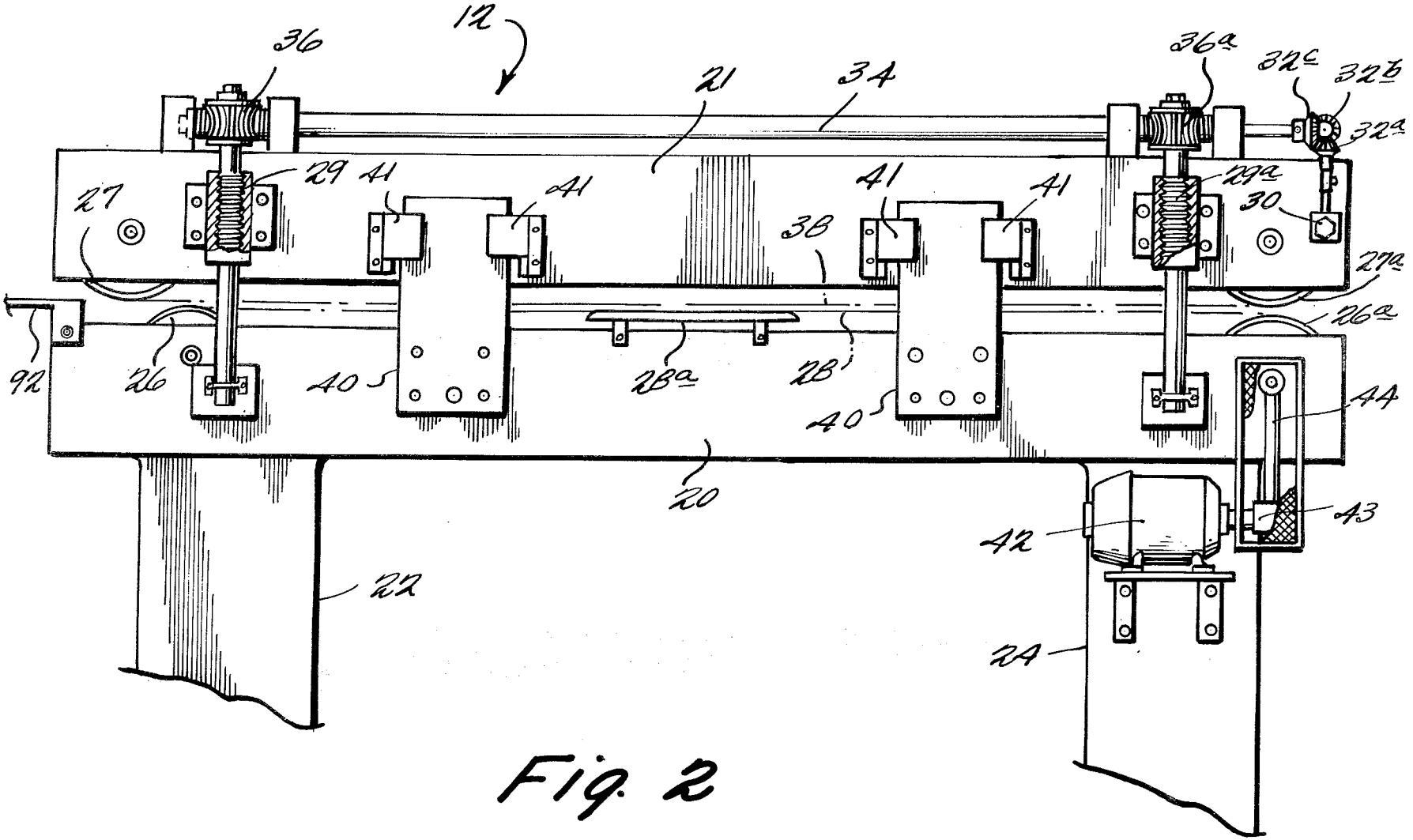
FIG. 2 illustrates an enlarged view of a typical conveying means employed in the present invention.

More specifically, with reference to FIGS. 1, 1*a* and 2, it may be seen that intermediate conveyors 12 are incorporated in a conveying system utilizing a pivotal conveyor 16 having air jet means with a downstream conveyor 18 also having air jet means. Depending upon the distance required for transportation of sheet material, conveyors 12 may be of various lengths and inclinations preceding and following pivotal conveyor 16. A typical conveyor 12 has a lower stage portion 20 which is secured to posts 22 and 24 which support conveyor 12 off of a floor surface or the like. Lower stage portion 20 journals rollers 26 and 26*a* which have an endless lower belt 28 running therebetween. An anti-slack guide 28*a* is provided beneath lower belt 28. Disposed above lower stage portion 20 is an upper stage 21 which is secured above lower stage 20 by means of upper stage lifting screws 29 and 29*a*. Upper stage lifting screws 29 and 29*a* may be adjusted by means of a main adjusting screw 30 which rotates tri-bevel gears 32*a*, 32*b* and 32*c*, which in turn rotate adjustable worm shaft 34 which engages worm gears 36 and 36*a* to displace upper stage screws 29 and 29*a*, respectively, in either an upward or downward direction to vary the relationship of upper stage 21 with respect to lower stage 20.

The adjustable feature of upper stage 21 with relation to lower stage 20 is of importance when it is considered that sheets of material which may be metal, plastic or other material, will be traveling at high rates of speed and will have a tendency to be lifted or flipped off belt 28. Therefore, the use of upper stage 21 which journals rollers or wheels 27 and 27*a* having an endless belt 38 is important in that a degree of downward pressure may be exerted against sheets of material traveling along endless belt 28 from one conveyor to a subsequent conveyor. Because upper stage 21 is adjustable upwardly and downwardly, sheet material of varying thicknesses may be readily incorporated by the aforedescribed conveyor. Upper stage guides 40 secured to lower stage 20 are held in slidable relation to upper stage 21 by brackets 41. Thus, upper stage 21 will be held in substantially rigid relationship with respect to lower stage 20.

In one preferred use of the present invention, it is contemplated that the maximum strip speed from the shearing device 14 will be approximately 1500 feet per minute, different speeds of course may be advantageously employed. As a consequence, each conveyor 12 will be constructed with a lower belt drive motor 42 connected by means of a gear box 43 and a drive shaft 44 to drive lower roller 26*a* on lower stage 20. It is also contemplated that each of the conveyors 12 may have to be driven at a somewhat higher speed than the preceding conveyors, in order that the transported sheets do not bunch up.

Figure 3:
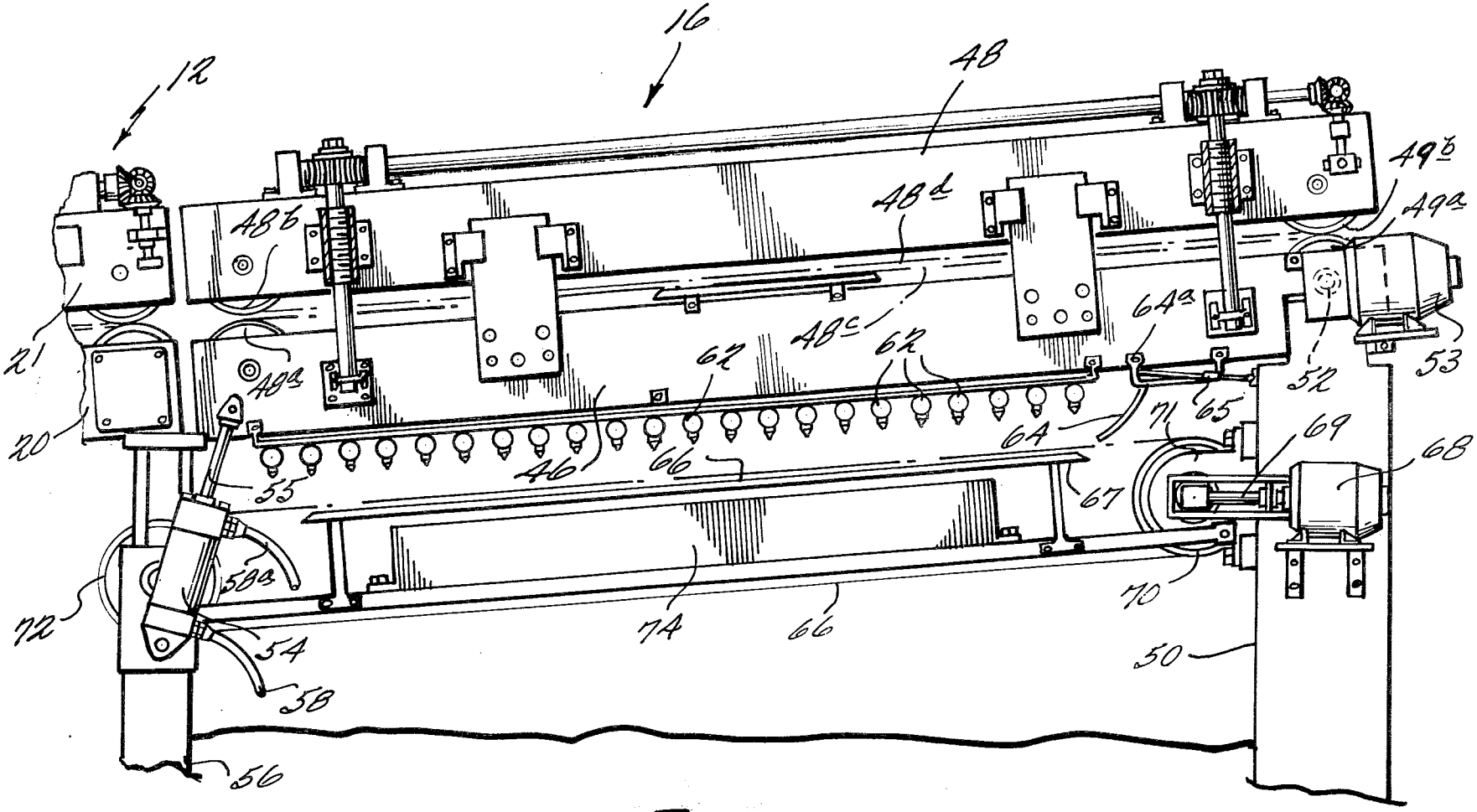
FIG. 3 is an illustration of the pivotally connected conveying means of the present invention disposed in a position for accepting sheets of material from a preceding conveying means.
Figure 4:
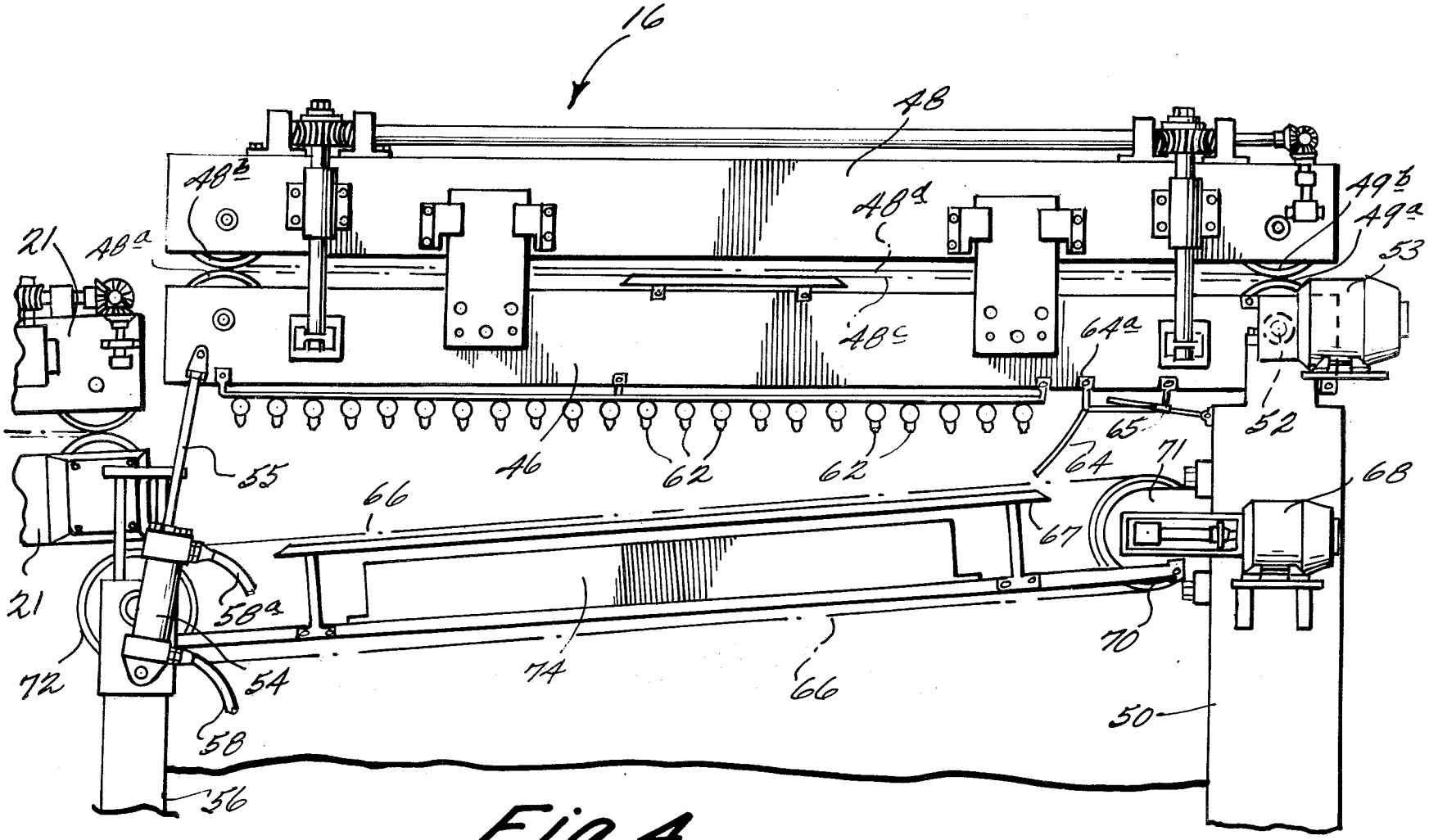
FIG. 4 illustrates an enlarged view of the pivotally connected conveying means disposed in a position which enables air jet means to blow air onto sheets of material being conveyed from a preceding conveying means.

The exemplary embodiment of the present invention uses conveyors 12 in conjunction with a pivotal conveyor 16 having air jet means and a downstream conveyor 18 also having air jet means. With reference to FIGS. 1, 3 and 4, the operation of the pivotal conveyor will be herewith described. Pivotal conveyor 16 incorporates a lower stage 46 and an upper stage 48 which are secured to each other in substantially the same manner as lower stage 20 is secured to upper stage 21 in conveyor 12. However, conveyor 16 has lower stage 46 pivotally connected to support 50 by means of shaft 52. Shaft 52 also may serve as a drive for rollers 48*a* and 49*a* which are driven by motor 52. At the opposite end of lower stage 46, an actuating means such as a hydraulic cylinder 54 with an arm 55 secure lower stage 46 in relationship with post 56 so that when hydraulic cylinder 54 is actuated by hydraulic fluid passing through hydraulic hoses 58 and 58*a*, lower stage 46 and correspondingly upper stage 48 may be raised and lowered in relationship to a preceding conveyor 12 by virtue of pivotal connection 52 which journals lower stage 46 onto post 50.

The operation and advantages of the pivotally connected conveyor 16 are as follows. With the pivotally connected conveyor 16 being disposed in a first or lowermost position as indicated in FIG. 3, sheets of material will pass from a preceding conveyor 12 or from the sheet producing source 14 directly between rollers 48*a* and 48*b* to be transported by belt 48*c*, either to a subsequent conveyor 12 or to downstream conveyor 18. If, during a production process, it is desired to stack sheets of material into a first stacker 60 as shown in FIG. 1, pivotal conveyor 16 may be displaced by means of hydraulic cylinder 54 and arm 55 to a second or upper position as indicated in FIG. 4.

A novel feature of the present invention resides in the use of an air jet means comprising a plurality of nozzles 62 which are secured to lower stage 46 of pivotal conveyor 16. With pivotal conveyor 16 displaced in an upper position, sheets of material which pass from a previous conveyor 12 are thrown out or ejected from the previous conveyor 12 without being further transported by belts 48*c* and 48*d*. Rather, the sheets of material are thrust against a sheet reversing guide 64 which substantially reverses the downstream travel of the sheets along a passline from conveyor 12. Sheets reversing guide 64 is secured to lower stage 46 by means of a bracket 64*a* which slidably engages a recoil piston 65 which, in the preferred adaptation, may be connected to post 56*a*. Recoil piston 65 ensures that the sheet reversing guide 64 will provide for a damping effect.

After the sheets have had their direction of travel reversed by sheet reversing guide 64, the sheets are blown downwardly by compressed air or similar gaseous fluid flowing through nozzles 62. The compressed air (originating from an air compressor, not shown) forces the sheets downwardly onto a lower endless reversing conveyor belt 66 at a rate faster than the sheets would fall by gravity. In one form of the present invention, lower belt 66 may be secured adjacent to posts 50 and 56*a* by means of rollers 70 and 72, but could also be secured to other means without attachment to the aforementioned posts. Belt 66 is driven by motor 68 connected by means of a drive shaft 69 to roller 70. A bracket 71 may be suitably secured to post 50 and provide a journal for shaft 69 to roller 70. A further roller 72 completes the lower conveyor reversing belt 66. Secured beneath the upper portion of belt 66 is a reversing belt anti-slack guide 67 which keeps reversing belt 66 from becoming slack. As a further aid to displacing the sheets downwardly onto reversing belt 62, there is employed an electromagnet 74 which will attract sheets of material having a metallic composition. The combination of the air jet nozzles 62 and the electromagnet will enable the sheets to be rapidly displaced downwardly onto reversing belt 66.

A first stacker 60 (see FIG. 1) is located adjacent to first reversing belt 66 so that sheets of material may be displaced from reversing belt 66 onto stacker 60. Stacker 60 is weight-responsive, i.e., as a sheet of material is displaced onto stacker 60 from reversing belt 66, stacker 60 will be moved downwardly to accept a subsequent sheet. The process is repeated until a stack of sheets of a predetermined number occupies stacker 60. It is contemplated that stacker 60 may be slidably engaged in the floor surface by a spring means or the like which is responsive to the weight of the sheets of material. A pallet may be placed on the top portion of the stacker 60 so that a forklift truck or the like could be driven into remove the sheets of material when stacker 60 becomes full. A rubber stop guide 60*a* (see FIG. 5) may also be secured at one end of the stackers so that sheets of material which are flung onto the stacker by means of the reversing belts have an absorbing impact surface on which to strike.

Figure 5:
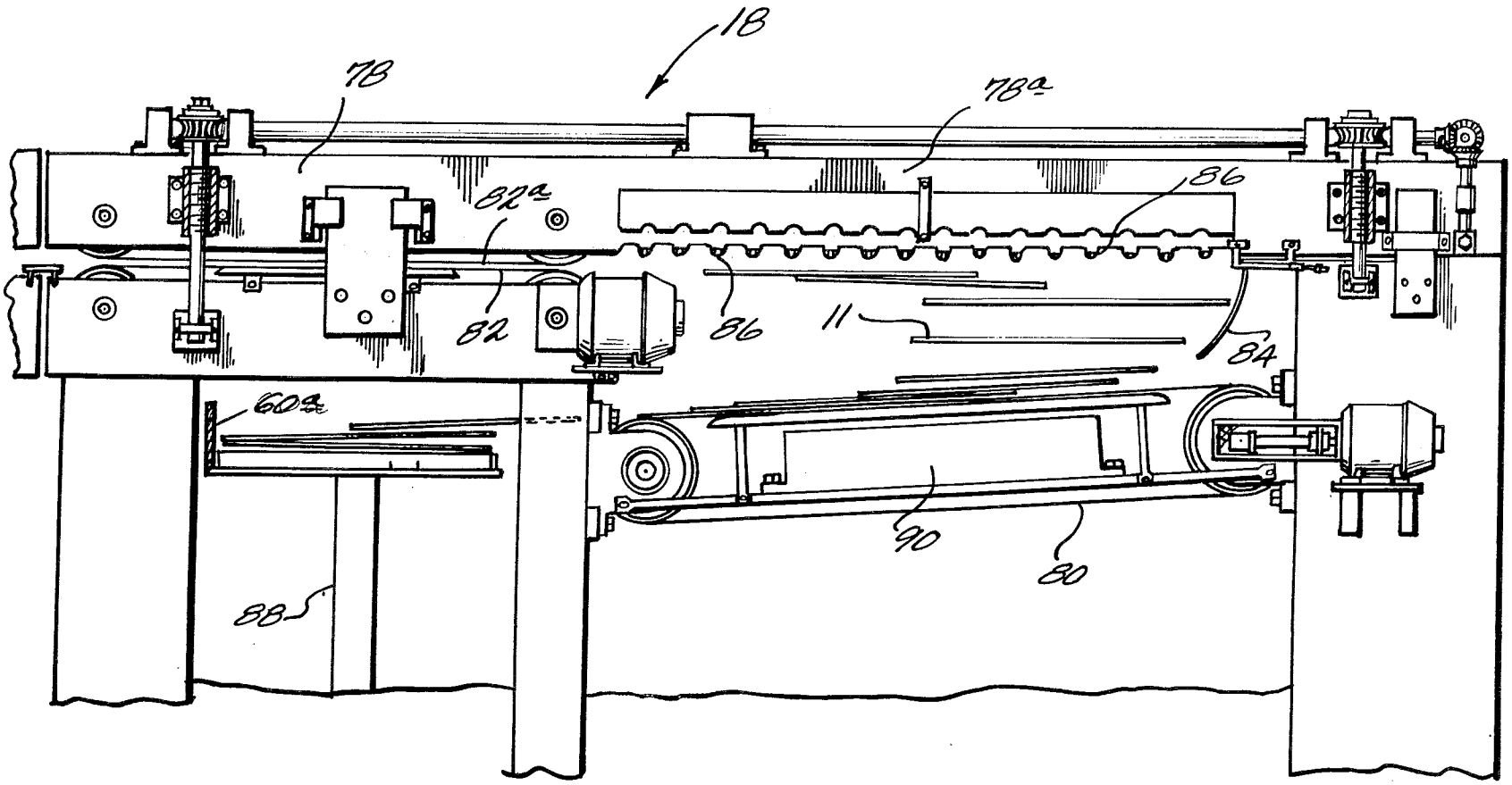
FIG. 5 is an illustration of an enlarged view of the conveying means which is located at the furthermost downstream position of the sheet material conveying and stacking apparatus.

From a viewing of FIG. 5, it may be seen that a downstream conveyor 18 having air jet nozzles 86 has an extension 78*a* secured to upper stage 78 of conveyor 18. Conveyor 18 has secured below it a reversing belt 80 similar to the reversing belt 66 of pivotal conveyor 16. Here, as sheets 11 travel from belts 82 and 82*a* along a passline of conveyance beneath nozzles 86, they are thrust onto another sheet reversing guide 84 whereupon compressed air or the like ejected from the nozzles 86 force the sheets of material onto reversing belt 80. The sheets are then transported by means of reversing belt 80 to a further weight-responsive stacker 88 constructed similar to stacker 60. Also, an electromagnet 90 may be used as a further aid in forcing sheets 11 downwardly onto reversing belt 80.

Further features of the conveyors 12 may be seen from a consideration of FIG. 1*a*. FIG. 1*a* illustrates that a plurality of belts 28 may be employed to transport a large number of sheets from a sheet producing source. Accordingly, conveyors 16 and 18 could also be advantageously constructed with a plurality of belts for transporting the sheets. Stackers 60 and 88 would be designed to accommodate such a transporting of a large number of sheets.

The operation of a typical sheet material conveying system in accordance with the present invention utilizing conveyors 12, 16 and 18 will now be particularly described. Assume that pivotal conveyor 16 is disposed in a first or downward position as shown in FIG. 3. Sheets of material will then pass from the sheet material producing source 14 along a plurality of conveyors 12 through pivotal conveyor 16 to downstream conveyor 18. As previously described, the sheets of material will strike reversing guide 84 and be rapidly displaced downwardly by means of air jet nozzles 86 and electromagnet 90 onto reversing belt 80 and thereupon transported to stacker 88. After stacker 88 is filled to a predetermined level, pivotal conveyor 16 may then be displaced to its second or upper position as shown in FIG. 4 whereupon the sheets of material passing from conveyor 12 along the passline will strike sheet reversing guide 64 and then be forced downwardly by means of air jet nozzles 62 and electromagnet 74 onto reversing belt 66. The sheets are then transported to stacker 60 whereupon they are stacked one on top of another.

During the operation of the conveying system in which conveyor 16 is disposed in its second or upward position, the sheets of material may be removed from stacker 88 and taken to the next manufacturing process or whatever. After stacker 60 becomes full, pivotal conveyor 16 may then be downwardly displaced by means of hydraulic cylinder 54 and arm 55 to the first or lowermost position whereupon sheets of material once again pass by means of belts 48*c* and 48*d* to downstream conveyor 18. The sheets of material are then stacked again on stacker 88. As may be readily appreciated, this procedure may be continuously repeated and thereby provide for a plurality of stacks of material at different locations. Certainly it is within the scope of the present invention that more than one pivotal conveyor 16 may be located within a conveying system.

Further embodiments of the present invention are also apparent from the above disclosure. For instance, pivotal conveyor 16 could be placed directly adjacent to a sheet producing source 14 for transport of sheets of material to a subsequent operation. Pivotal conveyor 16 could then be displaced to its second position so that sheets of material could be stacked adjacent to the sheet producing source. Another embodiment could be the use of downstream conveyor 18 adjacent to a sheet producing source. Further examples of the pivotal conveyor 16 and downstream conveyor 18 being arranged with conveyors 12 are numerous.

From FIGS. 1 and 2 of the present invention, a further feature of the present invention is shown wherein a main reject gate and motor box 92 may be used to reject sheets without a proper cut or having pin holes. An electric eye would be used to sense imperfections in the material. The main reject gate upon receiving such a signal would be pivotally displaced so as to block the material from being transported further along the conveying line. The rejected material would then pass into a reject bin 94 by means of reject conveyors 96 and 98 driven by suitable reject belt drive motors.

It is also contemplated that the sheet material conveying and stacking apparatus utilizing the pivotal conveyor 16 and downstream conveyor 18 in conjunction with a plurality of conveyors 12 may be automatically operated. Specifically, a sensing means (diagrammatically illustrated at 100) in FIG. 1 may be used to count the number of sheets passing outwardly from pivotal conveyor 16 when pivotal conveyor 16 is in the first position. After a predetermined number of sheets, sufficient to fill stacker 88 have passed thereby, sensing means or counter 100 would then actuate hydraulic cylinder 54 so that pivotal conveyor 16 would be displaced to the second or upward position. The sheets of material then passing to stacker 60 would also be counted by sensing means 100 until the number which would fill stacker 60 had been passed from the preceding conveyor 12. Sensing means 100 would then actuate hydraulic cylinder 54 so that pivotal conveyor 16 would then be displaced to its first position. The process would then be repeated as often as required for a particular manufacturing process.

While the invention has been particularly shown and described with reference to the foregoing preferred embodiments thereof, it will be understood by those skilled in the art that other changes in form and detail may be made therein without departing from the spirit and scope of the invention as defined in the appended claims.

What is claimed is:

1. An apparatus for conveying and stacking individual sheets of material, said device comprising:

a first means for conveying individual sheets disposed adjacent to a sheet producing source and arranged to receive sheets from said source;

a second conveying means which may be disposed in a first position for receiving and transporting the sheets from said first conveying means, said second conveying means also being movable to a second position which prevents the sheets from being received and transported by said second conveying means;

means disposed adjacent to said second conveying means for reversing the direction of conveyance of sheets which have passed from said first conveying means when said second conveying means is disposed in said second position;

a first air jet means disposed adjacent to said second conveying means and arranged to operatively urge the sheets toward a third conveying means when said second conveying means is in said second position;

a first stacking means for receiving sheets transported from said third conveying means; and a fourth conveying means disposed adjacent to said second conveying means for receiving and further transporting sheets from said second conveying means when said second conveying means is disposed in said first position;

wherein a second reversing means is operatively disposed adjacent to said fourth conveying means for reversing the direction of conveyance of sheets which have passed from said second conveying means to said fourth conveying means when said second conveying means is disposed in said first position, a second air jet means being disposed adjacent to said fourth conveying means for operatively urging the sheets onto a fifth conveying means, a second stacking means being disposed adjacent to said fifth conveying means for receiving sheets transported from said fifth conveying means, wherein the conveying means are disposed above a floor surface or the like by means of a plurality of supports, said second conveying means is pivotally secured at a first end thereof to one of said supports and has a second end which may be displaced in relation to a floor surface or the like so that said second conveying means is movable to first and second positions and a plurality of positions therebetween by being pivoted about said first end, wherein an actuating means disposed adjacent to said second end is arranged to pivotally move said second conveying means, wherein said actuating means comprises a hydraulic cylinder having an arm which is operatively connected to said second conveying means so that said second conveying means may be pivoted to a plurality of positions upon actuation of said hydraulic cylinder, wherein said first air jet means comprises a plurality of nozzles disposed above a passline of conveyance of the sheets from said first conveying means when said second conveying means is disposed in said second position, said first air jet nozzles providing for jets of air to be forced onto the sheets thereby urging the sheets toward said third conveying means, said first reversing means preventing the sheets from being displaced beyond a predetermined distance along the passline from said first conveying means, said nozzles being movable with said second conveying means.

2. The apparatus as described in claim 1 wherein said second air jet means also comprises a plurality of nozzles disposed above a passline of conveyance of the sheets from said fourth conveying means, said second air jet nozzles providing for jets of air to be forced onto the sheets passing from said fourth conveying means and urging the sheets toward said fifth conveying means, said second reversing means preventing the sheets from being displaced beyond a predetermined distance along the passline from said fourth conveying means.

3. The apparatus as described in claim 2 wherein said third and fifth conveying means are disposed adjacent to said first and second stacking means respectively, each of said stacking means being weight responsive so that sheets which are received thereupon will displace said stacking means a predetermined distance to allow subsequent sheets to be stacked thereupon.

4. The apparatus as described in claim 3 wherein said third and fifth conveying means are each provided with an electromagnet to further urge sheets of a metallic composition onto said third and fifth conveying means.

5. The apparatus as described in claim 3 wherein a sensing means is provided which communicates with said actuating means to maintain said second conveying means in said first position until said second stacking means contains a predetermined number of sheets, whereupon said sensing means then communicates with said actuating means to maintain said second conveying means in said second position so that the sheets will be transported by said third conveying means to said first stacking means until said first stacking means contains another predetermined number of sheets, whereupon said sensing means then communicates again with said actuating means to dispose said second conveying means back to said first position so that sheets will be continued to be received by said second stacking means.

6. The apparatus as described in claim 3 wherein at least one additional conveying means is disposed between said first conveying means and said second conveying means.

7. The apparatus as described in claim 3 wherein at least one additional conveying means is disposed between said second conveying means and said fourth conveying means.

8. The apparatus as described in claim 7 wherein at least one additional conveying means is disposed between said first conveying means and said second conveying means.

9. The apparatus as described in claim 8 wherein a sensing means is provided which communicates with said actuating means to maintain said second conveying means in said first position until said second stacking means contains a predetermined number of sheets, whereupon said sensing means then communicates with said actuating means to maintain said second conveying means in said second position so that the sheets will be transported by said third conveying means to said first stacking means until said first stacking means contains another predetermined number of sheets, whereupon said sensing means then communicates again with said actuating means to dispose said second conveying means back to said first position so that sheets will be continued to be received by said second stacking means.

10. The apparatus as described in claim 9 wherein said third and fifth conveying means are each provided with an electromagnet to further urge sheets of a metallic composition onto said third and fifth conveying means.

11. The apparatus as claimed in claim 1 wherein at least one rejecting means for diverting the imperfect sheets to a collection point is disposed between said first conveying means and said second conveying means.

12. An apparatus for conveying and stacking individual sheets of material, said device comprising:

a first means for conveying individual sheets disposed adjacent to a sheet producing source and arranged to receive sheets from said source;

a second conveying means which may be disposed in a first position for receiving and transporting the sheets from said first conveying means, said second conveying means also being movable to a second position which prevents the sheets from being received and transported by said second conveying means;

means disposed adjacent to said second conveying means for reversing the direction of conveyance of sheets which have passed from said first conveying means when said second conveying means is disposed in said second position;

air jet means disposed adjacent to said second conveying means and arranged to operatively urge the sheets toward a third conveying means when said second conveying means is in said second position;

stacking means for receiving sheets transported from said third conveying means;

wherein the conveying means are disposed above a floor surface or the like by means of a plurality of supports;

said second conveying means is pivotally secured at a first end thereof to one of said supports and has a second end which may be displaced in relation to a floor surface or the like so that said second conveying means is movable to first and second positions and a plurality of positions therebetween by being pivoted about said first end;

wherein an actuating means disposed adjacent to said second end is arranged to pivotally move said second conveying means;

wherein said actuating means comprises a hydraulic cylinder having an arm which is operatively connected to said second conveying means so that said second conveying means may be pivoted to a plurality of positions upon actuation of said hydraulic cylinder; and wherein said air jet means comprises a plurality of nozzles disposed above a passline of conveyance of the sheets from said first conveying means when said second conveying means is disposed in said second position, said air jet nozzles providing for jets of air to be forced onto the sheets thereby urging the sheets toward said third conveying means, said reversing means preventing the sheets from being displaced beyond a predetermined distance along the passline from said first conveying means, said nozzles being movable with said second conveying means.

13. The apparatus as described in claim 12 wherein said stacking means is weight responsive so that sheets which are received thereupon will displace said stacking means a predetermined distance to allow subsequent sheets to be stacked thereupon.

14. The apparatus as described in claim 13 wherein said third conveying means is provided with an electromagnet to further urge sheets of a metallic composition onto said third conveying means.

15. The apparatus as described in claim 14 wherein at least one additional conveying means is disposed between said first conveying means and said second conveying means.

16. The apparatus as claimed in claim 12 wherein at least one rejecting means for diverting the imperfect sheets to a collection point is disposed between said first conveying means and said second conveying means.

17. An apparatus for conveying and stacking individual sheets of material, said device comprising:

a first means for conveying individual sheets disposed adjacent to a sheet producing source and arranged to receive sheets from said source;

a second conveying means which may be disposed in a first position for receiving and transporting the sheets from said first conveying means, said second conveying means also being movable to a second position which prevents the sheets from being received and transported by said second conveying means;

means disposed adjacent to said second conveying means for reversing the direction of conveyance of sheets which have passed from said first conveying means when said second conveying means is disposed in said second position;

a first air jet means disposed adjacent to said second conveying means and arranged to operatively urge the sheets toward a third conveying means when said second conveying means is in said second position;

a first stacking means for receiving sheets tranported from said third conveying means; and a fourth conveying means disposed adjacent to said second conveying means for receiving and further transporting sheets from said second conveying means when said second conveying means is disposed in said first position;

wherein a second reversing means is operatively disposed adjacent to said fourth conveying means for reversing the direction of conveyance of sheets which have passed from said second conveying means to said fourth conveying means when said second conveying means is disposed in said first position, a second air jet means being disposed adjacent to said fourth conveying means for operatively urging the sheets onto a fifth conveying means, a second stacking means being disposed adjacent to said fifth conveying means for receiving sheets transported from said fifth conveying means, wherein the conveying means are disposed above a floor surface or the like by means of a plurality of supports, said second conveying means is pivotally secured at a first end thereof to one of said supports and has a second end which may be displaced in relation to a floor surface or the like so that said second conveying means is movable to first and second positions and a plurality of positions therebetween by being pivoted about said first end, wherein an actuating means for pivotally moving said second conveying means is connected to said second end of said second conveying means, wherein said first air jet means comprises a plurality of nozzles disposed above a passline of conveyance of the sheets from said first conveying means when said second conveying means is disposed in said second position, said first air jet nozzles providing for jets of air to be forced onto the sheets thereby urging the sheets toward said third conveying means, said first reversing means preventing the sheets from being displaced beyond a predetermined distance along the passline from said first conveying means, said nozzles being movable with said second conveying means.

* * * * *